US006561736B1

(12) United States Patent
Doleshal

(10) Patent No.: US 6,561,736 B1
(45) Date of Patent: May 13, 2003

(54) FRICTIONAL COUPLER AND STIFFENER FOR STRENGTHENING A SECTION OF PILING

(76) Inventor: Donald L. Doleshal, 31460 W. 135th St., Olathe, KS (US) 66061

( * ) Notice: Subject to any disclaimer, the term of this patent is extended or adjusted under 35 U.S.C. 154(b) by 0 days.

(21) Appl. No.: 09/714,905

(22) Filed: Nov. 17, 2000

(51) Int. Cl.[7] ..... E02D 5/60; E02D 31/00

(52) U.S. Cl. ..... 405/251; 405/211; 405/211.1; 405/216; 52/170; 52/729.1

(58) Field of Search ..... 405/211, 211.1, 405/212, 216, 231, 251; 52/170, 514, 623, 729.1, 731.1, 169.1, 169.9

(56) References Cited

U.S. PATENT DOCUMENTS

| | | | | | |
|---|---|---|---|---|---|
| 1,860,205 | A | * | 5/1932 | Schenker | 52/729.1 |
| 2,454,956 | A | * | 11/1948 | Young | 405/211 X |
| 3,333,429 | A | | 8/1967 | Dougherty | |
| 3,720,068 | A | | 3/1973 | Rosa | |
| 3,798,867 | A | * | 3/1974 | Starling | 52/729.1 X |
| 3,890,795 | A | | 6/1975 | Maurer | |
| 3,913,290 | A | * | 10/1975 | Billing et al. | 52/729.1 X |
| 3,934,422 | A | | 1/1976 | Fredrickson | |
| 3,939,665 | A | * | 2/1976 | Gosse et al. | 405/216 |
| 3,996,757 | A | * | 12/1976 | Liddell | 405/216 |
| 4,019,310 | A | * | 4/1977 | Fox | 405/216 X |
| 4,058,985 | A | * | 11/1977 | Liddell | 405/216 |
| 4,081,941 | A | * | 4/1978 | Van Ausdall | 52/729.1 X |
| 4,306,821 | A | * | 12/1981 | Moore | 405/216 |
| 4,571,913 | A | * | 2/1986 | Schleich et al. | 57/729.1 X |
| 4,610,571 | A | | 9/1986 | Lees | |
| 4,697,396 | A | | 10/1987 | Knight | |
| 4,721,418 | A | * | 1/1988 | Queen | 405/231 |
| 4,779,389 | A | | 10/1988 | Landers | |
| 4,968,182 | A | | 11/1990 | Westwell | |
| 5,022,134 | A | | 6/1991 | George | |
| 5,337,469 | A | | 8/1994 | Richey | |
| 5,573,354 | A | | 11/1996 | Koch | |
| 5,644,890 | A | * | 7/1997 | Koo | 52/742.14 |
| 5,813,800 | A | | 9/1998 | Doleshal | |
| 5,816,746 | A | | 10/1998 | Blair | |
| 5,829,920 | A | * | 11/1998 | Christenson | 405/216 |

FOREIGN PATENT DOCUMENTS

| | | | | |
|---|---|---|---|---|
| EP | 173446 | * | 3/1986 | 405/211 |
| GB | 2061452 | * | 5/1981 | 405/211 |

* cited by examiner

*Primary Examiner*—Jong-Suk (James) Lee
(74) *Attorney, Agent, or Firm*—Kenneth W. Iles

(57) ABSTRACT

Sheathing members surround the pile and are clamped to it by bolts inserted through flange members or portions outside the piles, which clamp the sheathing members against the pile above and below a deteriorated section of a pile and which bridge the deteriorated section of a pile. An embodiment designed for H-piles includes two channel members and one is placed in each channel of the portion of the H-pile to be repaired. A locking bar member is placed along a longitudinal edge of the H-pile and is clamped to the H-pile and the corresponding outwardly projecting flange portion of the channel patch member by nuts and bolts.

10 Claims, 8 Drawing Sheets

FRICTIONAL COUPLER AND STIFFENER FOR STRENGTHENING A SECTION OF PILING

CROSS-REFERENCE TO RELATED APPLICATIONS

Not Applicable.

STATEMENT REGARDING FEDERALLY SPONSORED RESEARCH OR DEVELOPMENT.

Not applicable.

MICROFICHE APPENDIX

Not applicable.

BACKGROUND OF THE INVENTION

1. Field of the Invention

The present invention is directed to a coupler for connecting two structural beams or piles. More particularly, the present invention is directed to a friction coupler for structural beams of the like and can be used to repair and rebuild structural beams having one or more damaged sections.

2. Description of the Related Art Including Information Disclosed Under 37 C.F.R. 1.97 and 1.98

Coupling two structural members together is often desirable. In some situations it is difficult or undesirable to weld or bolt the two members together. In other situations, there may be a damaged section in a single beam or member that must be repaired or replaced in order to reestablish the structural integrity and strength of the member. Since replacement of damaged piles is very expensive and since much of a damaged underwater pile typically remains sound (typically the length under the splash zone), many efforts to permit repair of piles have been made. Some of these have lead to issued patents.

U.S. Pat. No. 3,333,429, issued to Dougherty, on Aug. 1, 1967, discloses an "H-beam Piling" comprising fastening sections of H-beams together with a welded butt joint. A butt weld does not provide the strength necessary in many applications and naturally assumes that the two end to be joined are sound. This is obviously not the case when a pile has been damaged. If a replacement section is used, it could not be properly loaded prior to the butt welding of Dougherty.

U.S. Pat. No. 3,720,068, issued to De Rosa on Mar. 13, 1973, discloses a "Method and Apparatus for Splicing Replacement Pile Section to a Pile Stub" in which a bore is formed in the stub pile below the mud line and a vertically oriented drift pin is inserted into the bore. A concentric groove is cut into the pile stub and a matching bore and groove are cut into the end of the replacement pile section. A circular cross section sleeve is inserted into the groove in the stub pile and the replacement pile is placed on top of the stub pile. Suitable glue, such as epoxy is applied. Connector plates F are arranged to overlap the joint between the replacement pile section and the pile stub and are nailed into place with many nails (FIGS. 4, 61). A protective felt is wrapped around the joint and a rubber boot is placed over it. This system cannot work with steel H-piles and is only useful below the mud line since it has little shear strength and lateral support comes from the surrounding mud.

U.S. Pat. No. 3,890,795, issued to Maurer on Jun. 24, 1975, discloses a "Kit of Components and a Method of Protecting Steel Piling from Corrosion" comprising a tough flexible plastic jacket that is snugly gathered and cinched about an H-beam type piling to prevent corrosion. Maurer '795 does not and cannot be used to repair a damaged H-pile.

U.S. Pat. No. 3,934,422, issued to Fredrickson et al. on Jan. 27, 1976, discloses a "Pile Splicing Apparatus and Method" comprising building a reinforcing structure of reinforcing bar, concrete mesh reenforcement bar stock or the like, placing a concrete form bag about the reenforcement bar area, and filling the bag with concrete. If the splice is located below the mud line, the mud is excavated to a depth to allow the concrete to set up on bedrock or the like. This patent is enclosed for general reference. Fredrickson et al. '422 requires a lot of space between adjacent piles to accommodate its bulky concrete form bag and requires excessive labor in that it is basically an underwater concrete form, complete with an extensive reenforcement bar network.

U.S. Pat. No. 4,610,571, issued to Lees on Sep. 9, 1986, discloses a "Foundation system and Pile Coupling for Use Therein" comprising a circular cross section collar that is placed over the end of one pile section. The other pile section is inserted into the collar. Spring loaded pins in the collar are then inserted into horizontal holes that were pre-drilled in the ends of the two pile sections (see FIGS. 2–4.). Lees '571 assumes two sound butt ends of two pile sections that are to be joined together. This collar system will not work when the sections are damaged. Lees does not provide substantial shear strength and does not work with the irregularly shaped piles, such as H-piles.

U.S. Pat. No. 5,337,469, issued to Richey on Aug. 16, 1994, discloses a "Method of Repairing Poles" comprising removing the lowered damaged portion of a utility pole and replacing that section with a steel pole or stanchion. The top of the stanchion has a platform that the upper or remaining end of the utility pole rests on. A sleeve or split socket 52 is on the top of the stanchion. The socket is closed by adding any missing sections of the socket, which is then bolted together, surrounding a portion of the existing pile. The space between the socket and the pole is filled with urethane foam. The socket or sleeve includes roughly circular cross section sections, each having an outwardly extending flange, which each flange having a number of spaced apertures along its length. Flanges and bolt holes from adjoining flanges are bolted together (See, FIGS. 6, 7, and 8). This method cannot be used underwater without substantial modification and does not provide substantial shear strength. Further, it is designed for use with wooden poles and is not suitable for steel poles or H-piles. Moreover, the many steps required to utilize Richey '469 would make it uneconomical in underwater use.

U.S. Pat. No. 5,573,354, issued to Koch on Nov. 12, 1996, discloses a "Timber Pile Repair System" comprising a two piece jacket, with each section having a semi-circular cross section, and a radially extending flange on each end, with apertures through the flanges. The flanges from two sections are aligned when the two sections are placed about a circular cross section pile and then are bolted together (See FIGS., 1–4). Any voids from deteriorated pile sections can be filled with epoxy. Koch '345 cannot be used with H-piles. Further, the use of epoxy resins to file the voids in deteriorated pile sections is very expensive and labor intensive.

U.S. Pat. No. 5,813,800, issued to Doleshal on Sep. 29, 1998, discloses a "Process for Replacing and Loading a Damaged Section of a Pile." Doleshal '800 shows a two-piece circular cross section coupler for wooden piles, with a flange at each end of the coupler sections, which are bolted together along the flanges. The coupler also includes spikes that are driven into the circular pile (FIGS. 15A and 15B). The patent also discloses a H-pile coupler comprising flat steel plates bolted to the flat sides of the H-pile. A replacement H-pile section is fastened to the flat steel plate reinforcement members. Doleshal '800 can only be used in connection with an elaborate truss system used to support hydraulic rams that hold a two sections of H-pile apart and subject it to design loads while an entire replacement section of H-pile is inserted between the two pile ends. It is often desirable to repair a pile without the necessary expense used in this method and in a fashion that requires less working space.

In marine applications, pile is submerged underwater and the water typically damages the relatively small upper portion of the pile that is located in the splash zone, which usually extends from the highest level reached by the water's waves to a level about six to ten meters below the normal surface level of the water due to the action of the waves, entrained abrasives, marine animals, and the high levels of dissolved oxygen at these levels. Thus, normally only a relatively short portion of a pile is subjected to excessive deterioration. Replacing the entire pile is considerably more work and expensive than repairing the damaged section.

Each of these above methods is specially designed for a special circumstance and each falls short in other circumstances or has shortcomings set out above. Moreover, each is very labor intensive and, when the application is underwater, is therefore very expensive and dangerous to utilize.

Therefore there is a need for a method and apparatus for repairing damaged pile, particularly an underwater pile, sections that requires minimal working space around the pile; that requires a minimal amount of labor, and, particularly, underwater labor; that restores damaged pile sections to original design strength in compression, shear, and tension; and that provides a permanent repair for the life of the pile.

BRIEF SUMMARY OF THE INVENTION

Accordingly, it is a primary object of the present invention to provide an apparatus for repairing damaged pile sections, particularly an underwater pile, that requires minimal working space around the pile.

It is another object of the present invention to provide an apparatus for repairing damaged pile sections that requires a minimal amount of labor, and, particularly, underwater labor.

It is another object of the present invention to provide an apparatus for repairing damaged pile sections that restores the damaged pile section to its original design strength in compression, shear, and tension.

It is another object of the present invention provide an apparatus for repairing damaged pile sections that provides a permanent repair for the life of the pile.

The frictional coupler and stiffener 10 works by providing at least one sheathing member that runs from a sound upper portion of a pile to be repaired to a lower sound portion of a pile to be repaired and is firmly clamped to the upper sound portion of the pile and to the lower sound portion of the pile, thereby transferring the compressive load on the pile from the upper sound portion of the pile to the sound lower portion of the pile, bypassing the need for the damaged or deteriorated pile section to carry this compressive load. This type of structure and this principle of operation is employed in all embodiments of the frictional coupler and stiffener. In some applications, a single sheathing member can be fastened to the pile above and below the damaged or deteriorated section, with a clamping ring or plate bolted to the pile. In other applications, which are likely more common in practice, more than one sheathing member, or channel reinforcing member, is employed to provide symmetrical loading of the coupler. Clamping forces are provided by highly tightened bolts that pass through apertures in flanges of the sheathing members, which lie outside the pile, and are threaded with mating nuts. A spacer member or element is located adjacent to the outer edge of adjacent flanges farther from the pile than the bolt holes so that tightening the nuts and bolts squeezes and clamps the frictional coupler and stiffener rather than simply bending the flanges. The flanges, if they bend, pinch the sheathing members more tightly about the pile since their outer ends cannot move closer together due to the spacer member, which, for these purposes, is essentially incompressible at the forces used in this application.

A frictional coupler and stiffener (hereinafter "frictional coupler") for structural beams and piles according the present invention basically provides a patch or a bridge about a damaged pile section, which is clamped to the pile along the damaged pile section and is also clamped to a sound portion of the pile above and below the damaged section. The frictional coupler and stiffener is designed to be used wherever a pile needs reinforcement. This most likely will occur when the pile has been damaged, as for example by being hit by a ship, or deteriorated through exposure to the water and waterborne organisms. In some cases, however, it may desirable to utilize the frictional coupler and stiffener simply to strengthen a sound pile due to the desire to increase the load on the supported structure, such as a pier or dock, beyond the original design load.

In one embodiment adapted for an H-pile, a channel patch member comprising a basically U-shaped channel is fastened to each corresponding channel of the sound portions of the H-pile, contacting it above and below the damaged or deteriorated section of the H-pile by one or more bolts and nuts. A flange portion of each outer edge of each channel patch member extends beyond the corresponding edge of each H-pile channel and each flange includes a row of apertures. A locking bar includes a row of apertures that align with theapertures of the flanges of the channel patch members and includes a flange portion that is the same thickness as the material the H-pile is made from. The locking bar flange is perpendicular to the locking bar and extends throughout the length of the locking bar. Four separate locking bars are used-one for each channel patch flange portion and are placed on the outer surface of the H-pile flange portions. The locking bars are bolted to the flange portions of the channel patch members along the entire rows of aligned apertures. The resulting frictional coupler and stiffener provides a patch for a deteriorated or damaged section of an H-pile that is as strong as the original design specifications of the H-pile.

An embodiment adapted for repair of damaged cylindrical piles includes a plurality of metal sheets bent into an arcuate shape on the same radius as the cylindrical pile to be repaired, with a flange projecting outwardly from the vertical edges of each section. A plurality of aligned holes allows adjacent flanges to be bolted together. A flange spacer element at the outer edge of one flange prevents the outer edges of the flanges from being bent, thereby assuring that the compressive forces from tightening the bolts will be principally directed to squeezing the cylindrical pile itself.

Other objects and advantages of the present invention will become apparent from the following description taken in connection with the accompanying drawings, wherein is set forth by way of illustration and example, the preferred embodiment of the present invention and the best mode currently known to the inventor for carrying out his invention.

DETAILED DESCRIPTION OF THE INVENTION

Figure 1:
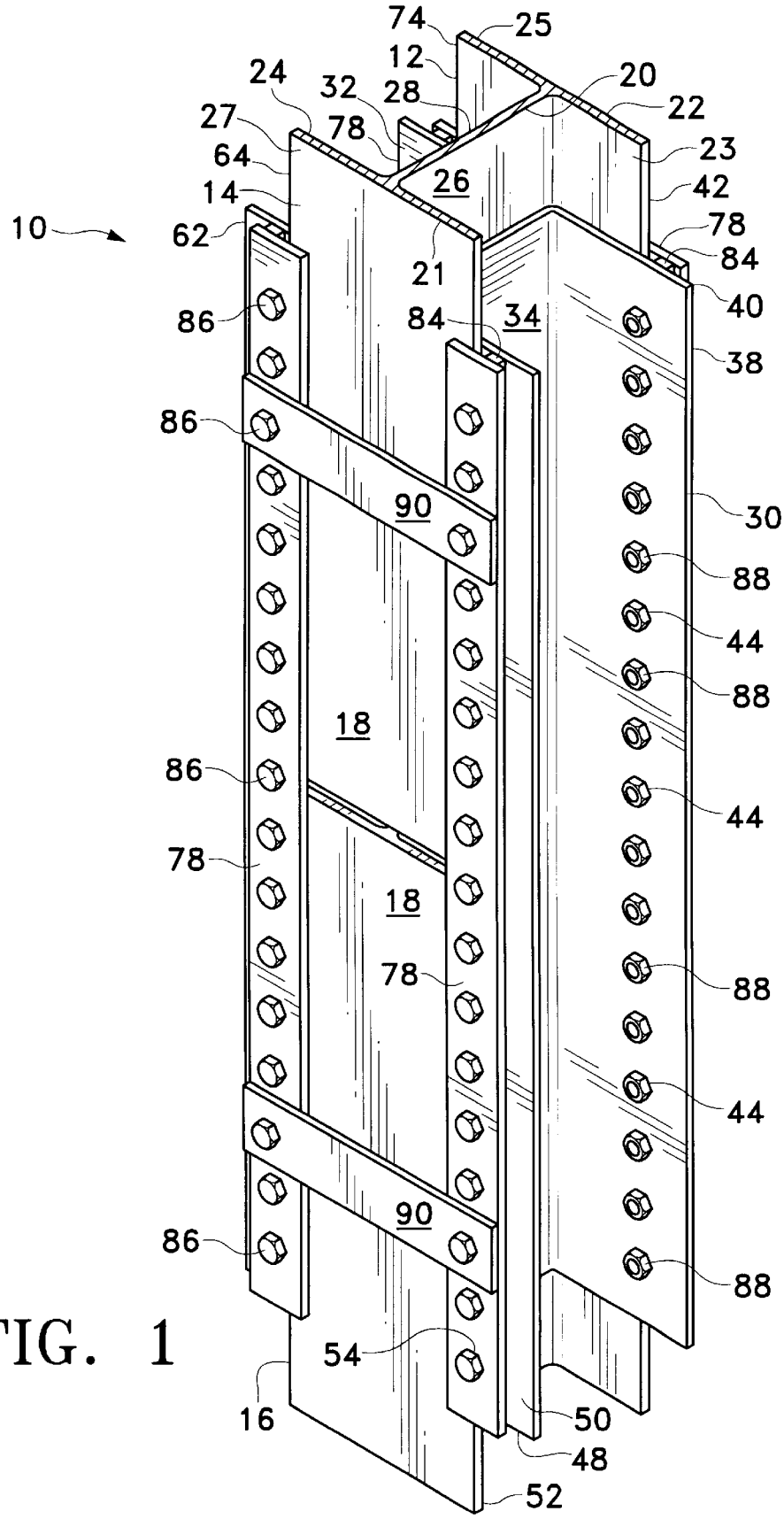
FIG. 1 is a perspective view of a frictional coupler and stiffener according to the present invention installed on an H-pile.
Figure 1A:
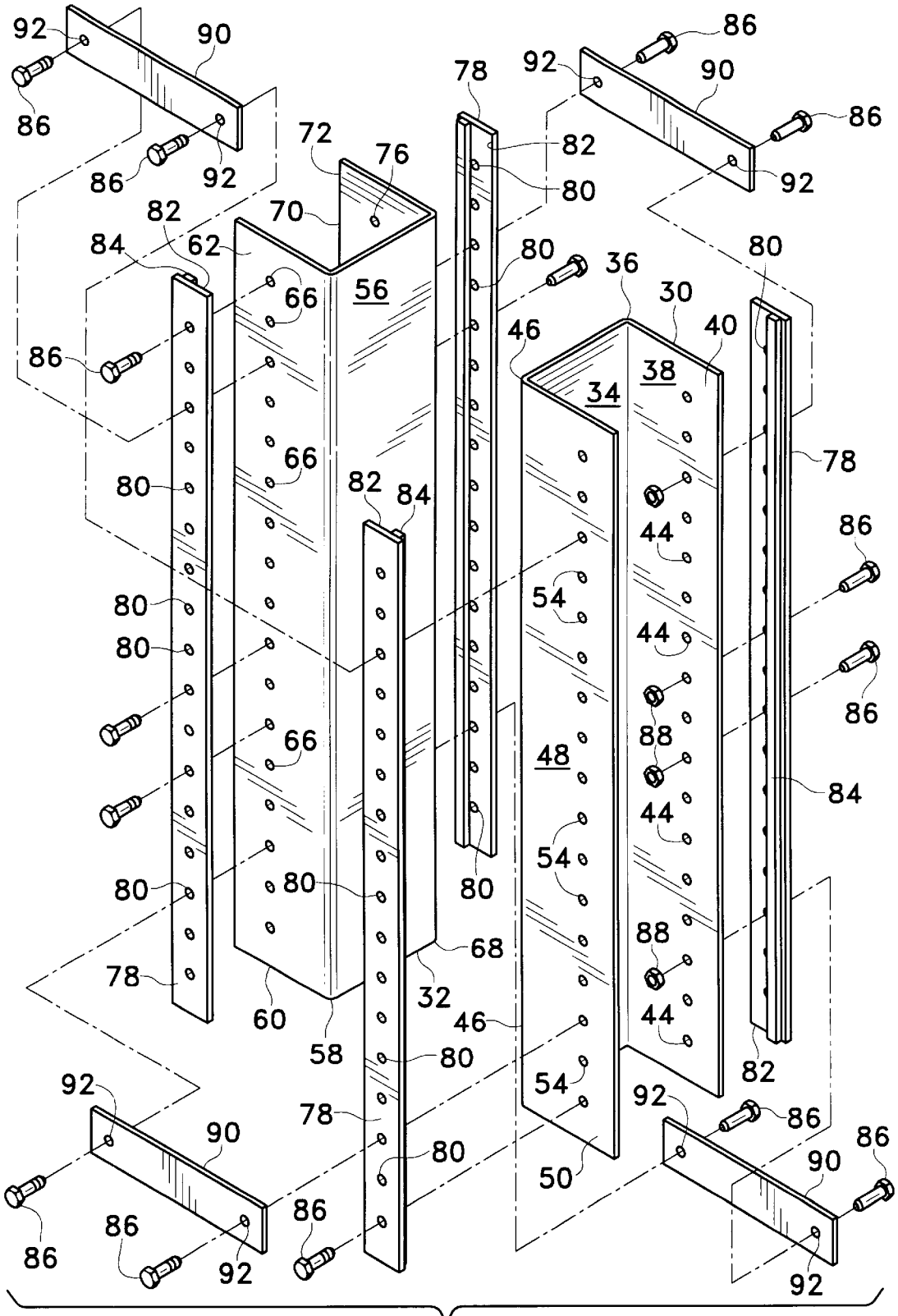
FIG. 1A is an exploded view of the frictional coupler and stiffener of FIG. 1.
Figure 5:
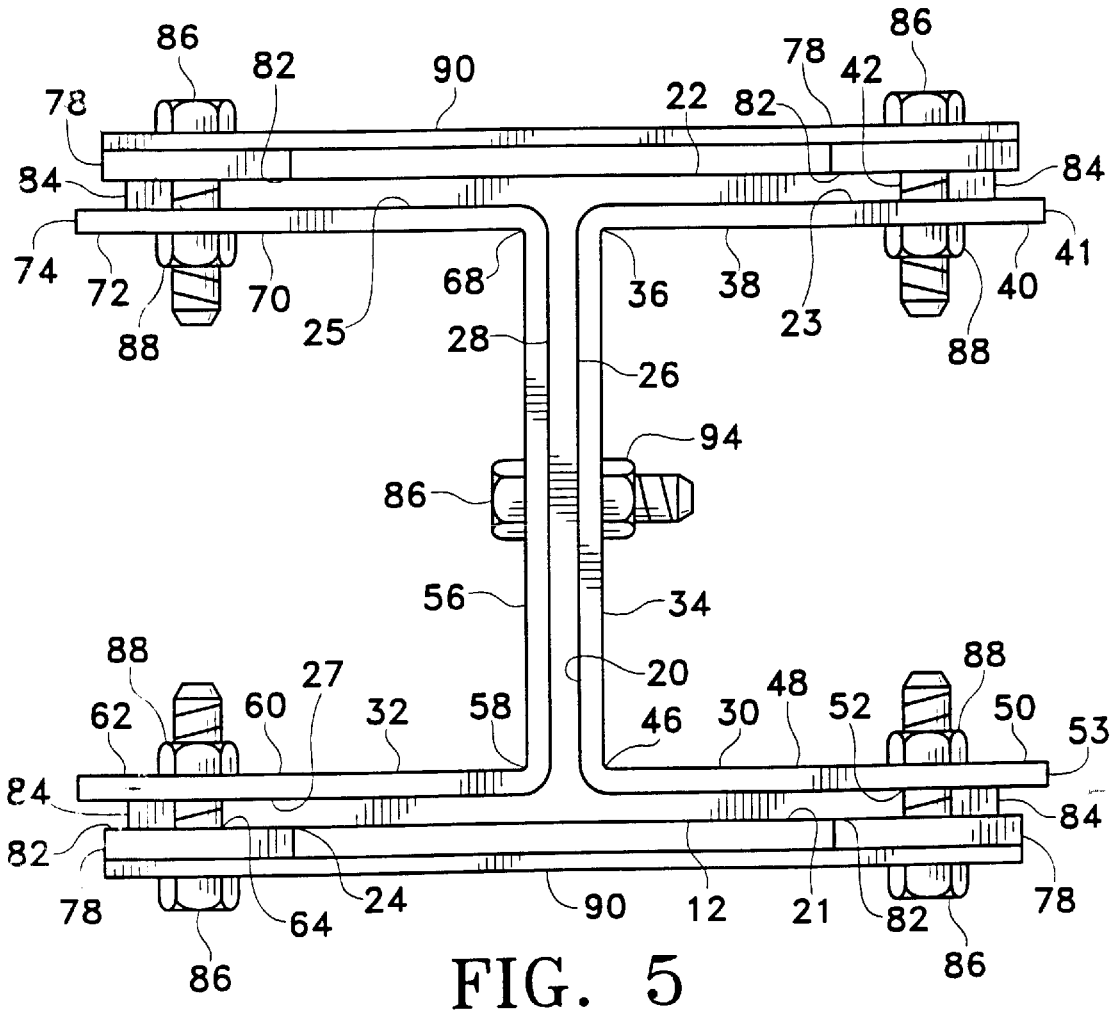
FIG. 5 is a top plan view of the frictional coupler and stiffener and H-pile of FIG. 1.

Referring to FIGS. 1, 1A a frictional coupler and stiffener (frictional coupler 10) for structural beams and piles 10 has been used to repair a damaged H-pile 12 having a sound upper portion 14, a sound lower portion 16 and a damaged or deteriorated intermediate portion 18. FIG. 1A shows the frictional coupler 10 itself in an exploded view that clearly shows the elements of the frictional coupler 10 The H-pile is a steel I-beam that is vertically oriented and includes a flat central beam element 20 having a first perpendicular flange portion 22 lying along one end of the central beam element 20 and a second perpendicular flange portion 24 lying along a second end of the central beam element 20, with flange portions 22, 24 being parallel to each other. The flange portions 22, 24 have a longitudinal centerline which lies along the respective edge of the central beam element. That is, the flange portions 22, 24 each provides the entire width of the H-pile 12 and forms a separate arm on either side of the flat central beam element 20 of the H-pile 12. The four arms of the H-pile are shown in FIGS. 1 and 5 as arms 21, 23, 25, and 27. The H-pile is typically made from a single extrusion and so is one piece. This structure forms a first U-shaped channel 26 on one side of the H-pile 12 and a second U-shaped channel 28 on the other side of the H-pile 12. A first channel patch member 30 (see also FIG. 6) the frictional coupler 10 is nested within the first U-shaped channel 26 and a second channel patch member 32 is nested within the second U-shaped channel 28.

Figure 6:
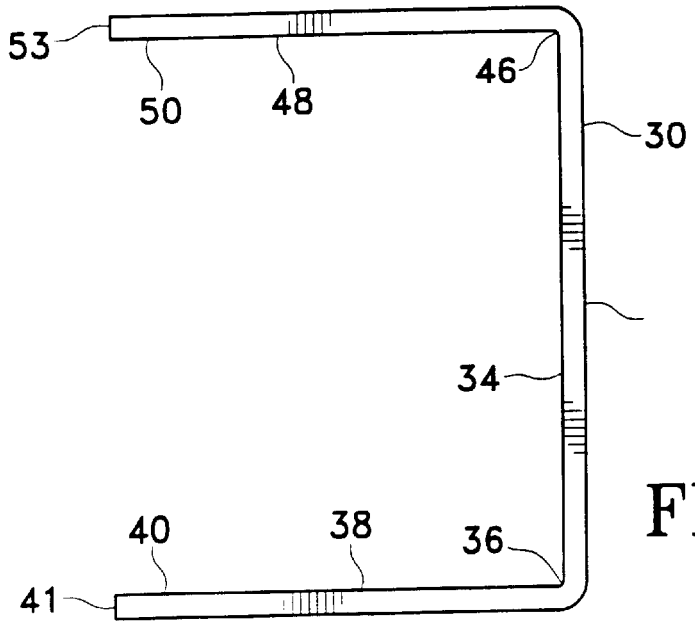
FIG. 6 is a top plan view of the U-bracket component of the frictional coupler and stiffener of FIG. 1.

Referring to FIGS. 1, 1A, and 6, the first channel patch member 30 includes a back plate, or wall 34 having a right-hand bend or edge 36 that leads to a right-hand side wall 38, which extends to an outer right-hand side flange 40, that extends beyond the right-hand edge 42 of the first U-shaped channel member 26 of the H-pile 12 to an outer edge 41 of the right-hand side wall 38 of the first channel patch member 30. The outer right-hand side flange 40 includes a plurality of apertures 44 aligned along a straight line that lies beyond the right-hand edge 42 of the first U-shaped channel member 26 of the H-pile 12 terminating in an outer edge 53 of the left-hand side wall 48 of the channel patch member 30. Similarly, a left-hand bend or edge 46 of the back plate or wall 34 leads to a left-hand side wall 48, which extends to an outer left-hand side flange 50 that extends beyond the left-hand edge 52 of the first U-shaped channel member 26 of the H-pile, terminating in an outer edge 53 of the left-hand side wall 48. The outer flange left-hand side includes a plurality of apertures 54, which are aligned along a straight line. The rows of apertures 44, 54 are located along a portion of the respective outer flanges 40, 50 that is beyond the edges of the first U-channel 28.

The second flange patch member 32 includes a back plate or back wall 56 having a right-hand bend 58 that leads to a right-hand side wall 60, which extends to an outer right-hand side flange 62, that extends beyond the right-hand edge 64 of the second U-shaped channel member 26 of the H-pile 12. The outer right-hand side flange 62 includes a plurality of apertures 66 aligned along a straight line that lies beyond the right-hand edge 64 of the second-U-shaped channel member 28 of the H-pile 12. Similarly, a left-hand bend 68 of the back plate or back wall 56 leads to a left-hand side wall 70, which extends to an outer left-hand side flange 72 that extends beyond the left-hand edge 74 of the second U-shaped channel 28 of the H-pile 12. The outer left-hand side flange 72 includes a plurality of apertures 76, which are aligned along a straight line that lies beyond the edge 74 of the second U-shaped channel 28 portion of the H-pile 12.

Both the first and second flange patch members 30, 32 are really identical and interchangeable. The terms left-hand and right-hand refer to the orientation when the viewer is looking toward the back plate or back wall 34, 56 and the respective side walls 38, 48 or 60, 70 are projecting toward the viewer. The back plates or back walls 34 and 56 are sized to fit closely into the first or second U-shaped channel 26 or 28 of the H-pile 28. When a channel patch member 30, 32 is seated within the each of the two U-shaped channels 26 and 28 of the H-pile, there are four flanges of the channel patch members 30, 32, two from the channel patch member 30 and two from the channel patch member 32, that project beyond the edges of the U-shaped channels of the H-pile 12 and include the rows of apertures that lie beyond the associated edges of the H-pile channels.

Figure 4:
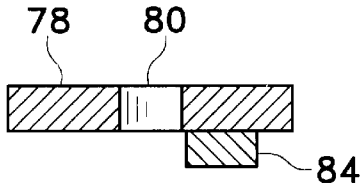
FIG. 4 is a sectional view taken along lines 4—4 of FIG. 3.
Figure 3:
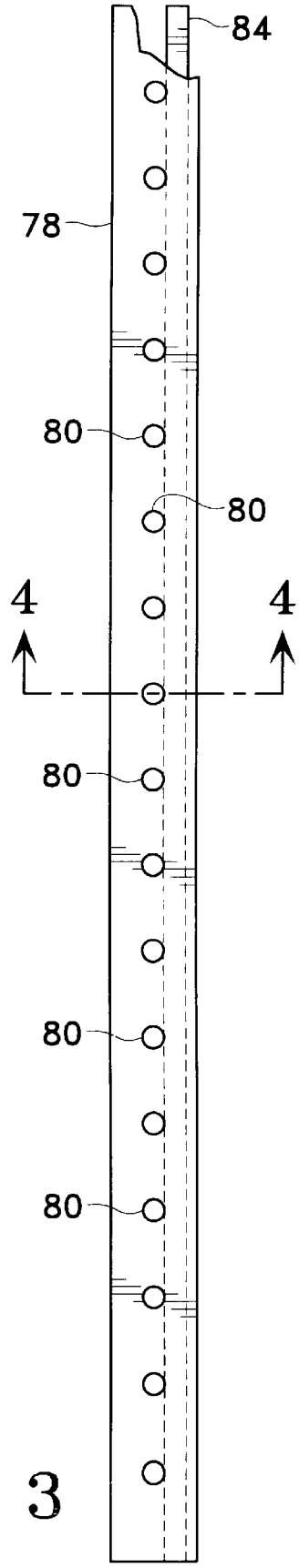
FIG. 3 is a side elevation, partially broken away, of a clamping strip for use with the present invention.

Still referring to FIGS. 1, 1A, and as best seen in FIGS. 3, 4, a locking bar 78 is an elongated steel bar having a plurality of aligned apertures 80 aligned along a straight line. On a rear face 82 of the locking bar is a flange 84 that runs along the entire length of the locking bar 78 and is a straight up-standing member having a height that is equal to the thickness of the metal the H-pile is made from. The flange 84 may be a separate bar that is fixed to the locking bar 78 by welding or the like or may be an integral portion of the locking bar 78, which would be extruded in this case. All apertures, length cuts and so forth are prepared prior to installation of the coupler 10 so that no drilling or welding is done underwater. All apertures in aligned rows 44, 66, 80 are located in a marginal edge of the respective flanges so that the apertures lie beyond the outer edges of the arms 21, 23, 25, or 27 of the H-pile 12 and are spaced the same distance apart in each row so that the apertures 80 in the locking bar 78 can always be lined up with corresponding apertures 44, 66 in the first and second channel patch members 30, 32. A single locking bar 78 element may be used to fasten all the outer flanges 40, 50, 62, 72 of the first and second channel patch members 30, 32 by rotating the locking bar 78 so that the flange 84 faces an outer flange 40, 50, 62 or 72 and lies outside the corresponding edge 42, 53, 64 or 74 of the H-pile 12.

Figure 2:
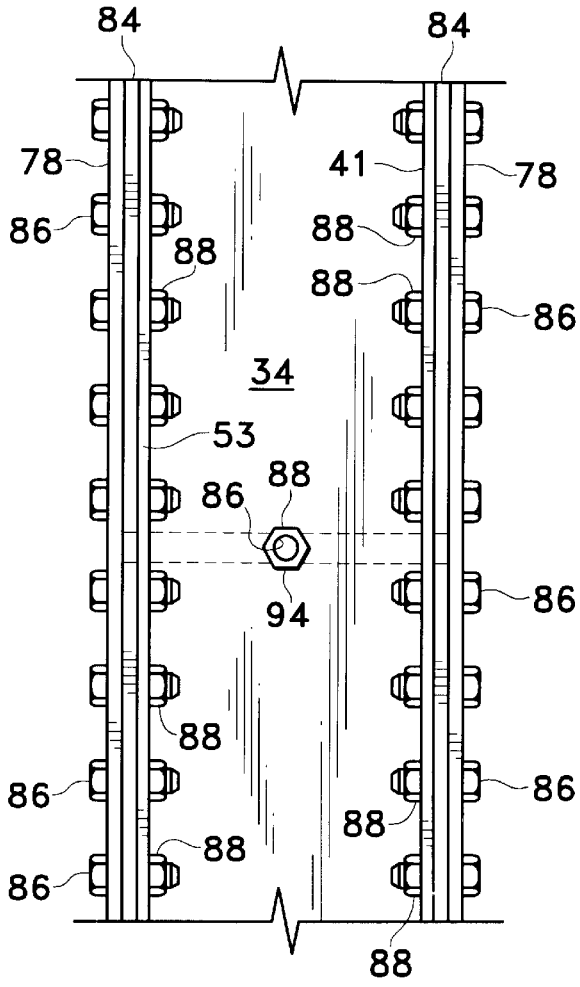
FIG. 2 is side elevation of a portion of the frictional coupler and stiffener and H-pile of FIG. 1.

To install the frictional coupler 10, first the length of the area to be repaired is measured. The coupler should be attached for a distance of 1–3 meters above and below the damaged portion of the pile. The first and second channel patch members 30, 32 and related locking bars are cut to the appropriate length and then lowered to the work site, where the channel patch members 30, 32 are placed into the U-shaped channels 26 and 28 of the H-pile. As shown in FIG. 2, the channel patch members 30, 32 are secured in place against the H-pile 12 by at least one bolt 86 passed through an aperture 94 that penetrates both channel patch members 30, 32, as best seen in FIG. 5, and the H-pile 12 and is secured by the nut 88. More than one such fastening point may be used, but a minimum of such fittings should be used as expensive underwater drilling of the H-pile is required for this step. These are, however, the only holes that need to be drilled underwater. A locking bar 78 is then installed so that the flange 84 is pointing toward the related flange of the channel patch member 30, 32, where it serves as a reinforcing rib to prevent the collapse of the locking bar 78 and the flange of the channel patch member 30, 32 when the bolts 86 are inserted into the apertures and secured by the nuts 88. A bolt 86 is inserted into each of the sets of rows of aligned apertures 44, 54, 66, and 76 and through aligned apertures 80 in locking bar 78 members and secured by the nuts 88. This provides large clamping forces between each of the four locking bars 78 and the flanges 40, So, 62, or 72 of the channel patch members 30, 32 that each locking bar 78 is fastened to. The respective flanges of the H-pile 12 are sandwiched between and clamped to the locking bars 78 and the respective flanges 40, 50, 62 and 70 of the channel patch members 30, 32, which provides the connection between the frictional coupler 10 and the H-pile 12. The locking bar 78 flange 84 is required to maintain the locking bar 78 and the respective flanges 40, 50, 62 and 70 of the respective channel patch member 30, 32 parallel during and after tightening the nuts 88 and bolts 86. The locking bar 78 flange 84 is the same thickness as the flange portions 22, 24 of the H-pile 12.

A reinforcing strap 90, which is a flat rectangular section of bar stock, includes an aperture 92 in each end and is placed perpendicular to a pair of adjacent locking bars 78, that is locking bars that lie along one flange portion 22 or 24 of the H-pile 12, and secured through the apertures that are used to connect the locking bar 78 to the corresponding apertures in the channel patch members 30 or 32. One reinforcing strap is placed above the deteriorated section 18 of the H-pile 12 and another is placed below the deteriorated section 18 of the f-pile 12. Additional reinforcing straps 90 may be applied if desired. The reinforcing straps 90 increase lateral strength and prevent the coupler 10 from wiggling from side to side. In another embodiment, the reinforcing straps 90 may run across two locking bars 78 at an angle other than 90° so that they form triangular reenforcement shapes.

Figure 7:
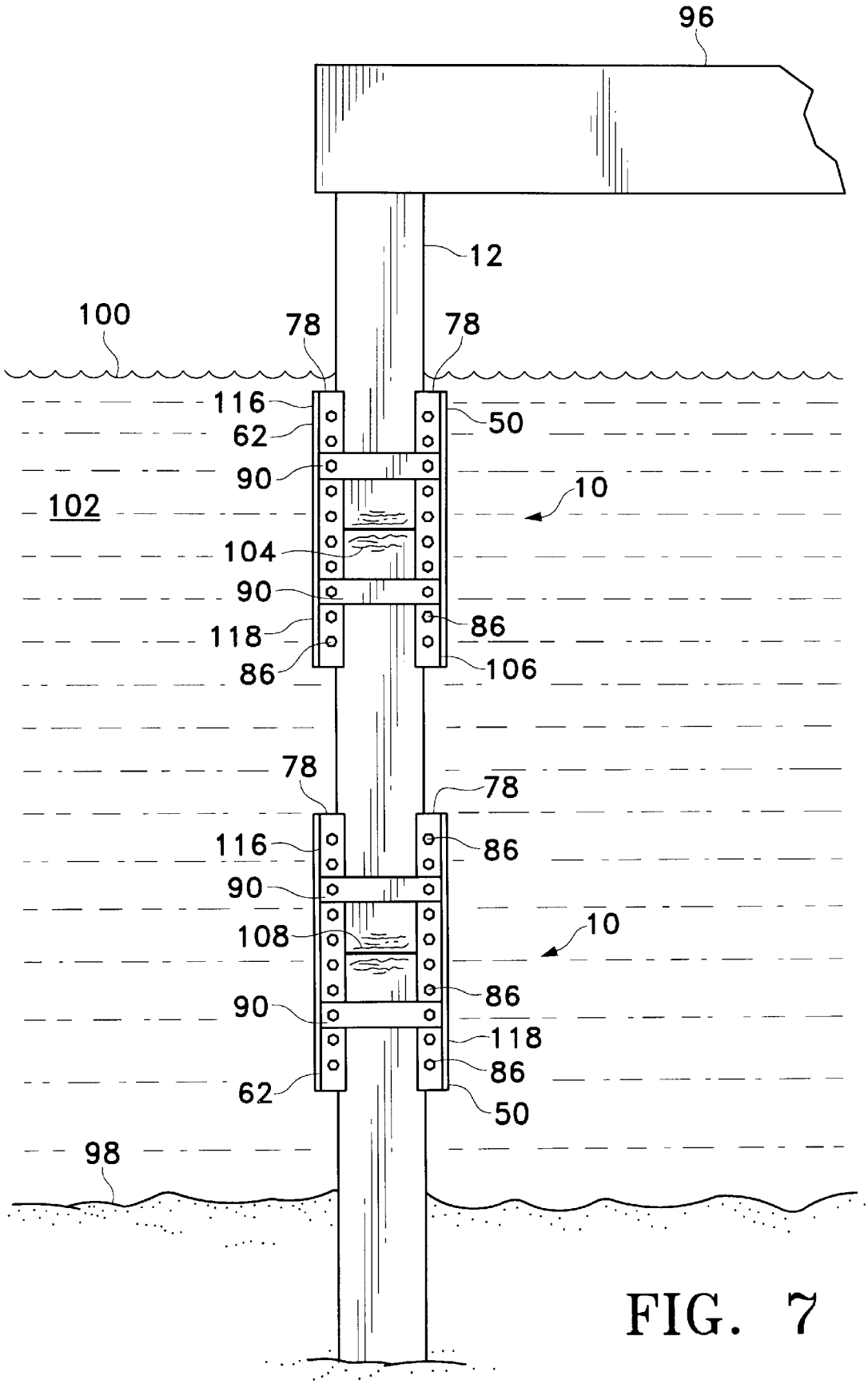
FIG. 7 is a side elevation showing two frictional couplers according to the present invention installed on an H-pile underwater to provide a replacement section in a damaged H-pile.
Figure 10:
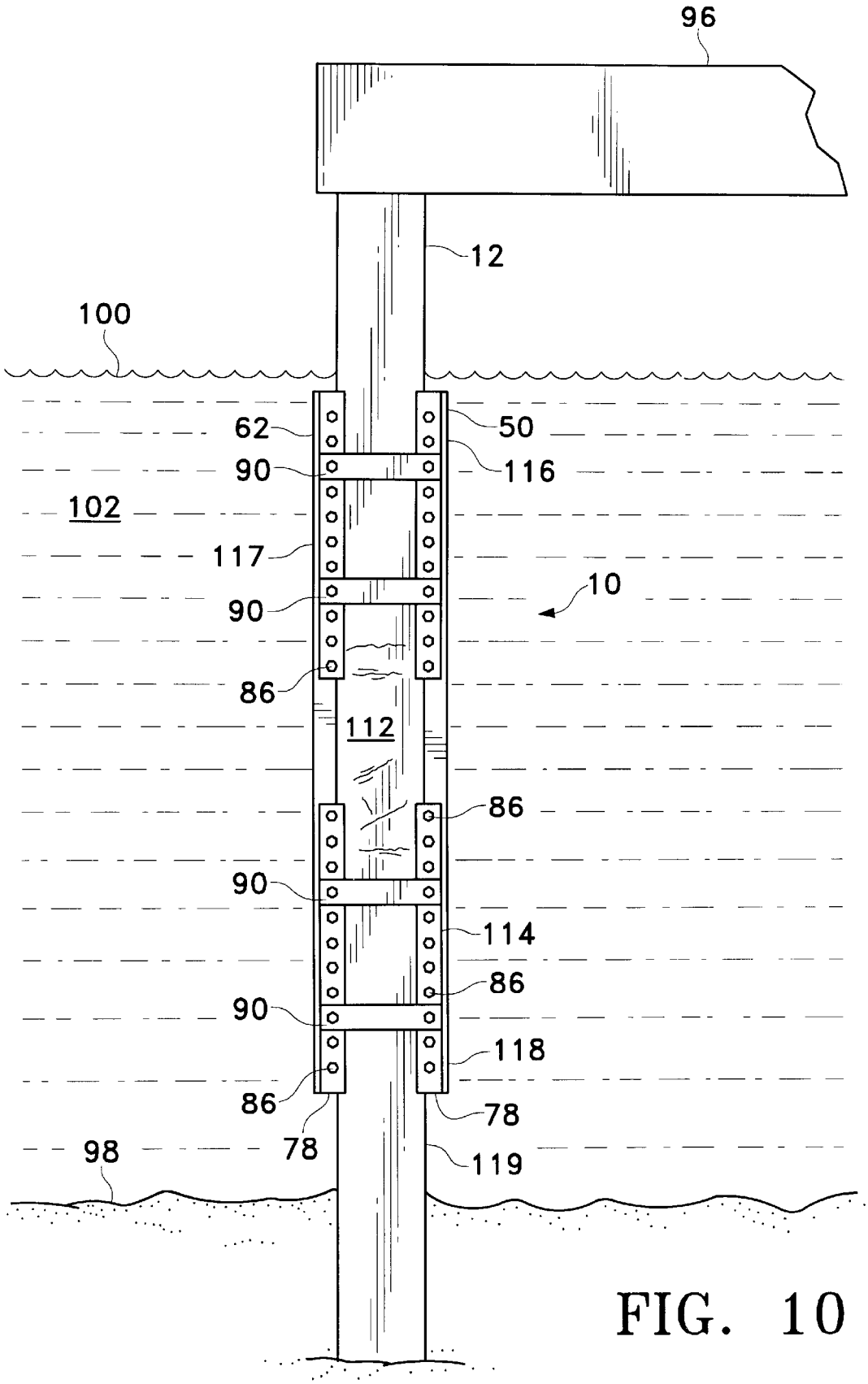
FIG. 10 is a side elevation of the frictional coupler and stiffener of FIG. 1 shown used as a replacement pile section for use in bridging a damaged section of a pile without removing the damaged section.

Referring to FIGS. 7 and 10, a pier 96 or other structure is supported by at least one H-pile 12 that is sunk below the mud line 98 to support the pier 96. Most of the H-pile 12 is submerged under the water 100, which typically damages a relatively small upper portion of the H-pile that is located in the splash zone 102, which usually extends from the highest level reached by the water's waves to a level about six to ten meters below the normal surface level of the water due to the action of the waves and the high levels of dissolved oxygen at these levels. Thus, normally only a relatively short portion of a pile such as the H-pile 12, is subjected to excessive deterioration.

Referring to FIG. 7, the H-pile 12 includes an upper deteriorated zone 104 that is bridged by an upper frictional coupler 106 utilizing a frictional coupler for structural beams and piles 10 and a lower deteriorated zone 108 that is bridged by a lower frictional coupler 110 according to the present invention.

Referring to FIG. 10, a longer area of deterioration 112 of the H-pile 12 is located in the splash zone 102 and is entirely bridged by an elongated frictional coupler 114 according to the frictional coupler for structural beams and piles 10 as described above. Additional reinforcing straps 90 are used, including for example the two pairs shown in FIG. 10. In any case, the frictional coupler 10 bridges the entire deteriorated section 18 of the H-pile 12 and includes an upper end 116 and a lower end 118 that are both connected to a sound portion of the H-pile 12. In every case, the first and second U-shaped channel members 26, 28 run the entire length of the deteriorated area 118 to be bridged, but the locking bars 78 do not need to run the entire length of the deteriorated area 112, The strength of the coupler 10 derives from the first and second U-shaped channel members 26, 28, which transfer compressive and shear loads from an upper sound portion 117 of the pile 12 to a lower sound portion 119 of the pile 12, thereby bridging the damaged or deteriorated section 112 of the pile 12. The locking bars 78 clamp the channel members 26, 28 securely onto the sound portions 117, 119 of the pile 12. The locking bars 78 need extend downwardly only the distance of three bolts 86 into the deteriorated area 112 in order to provide sufficient clamping force so that the coupler 10 can sustain the design loads of the pile 12.

Figure 8:
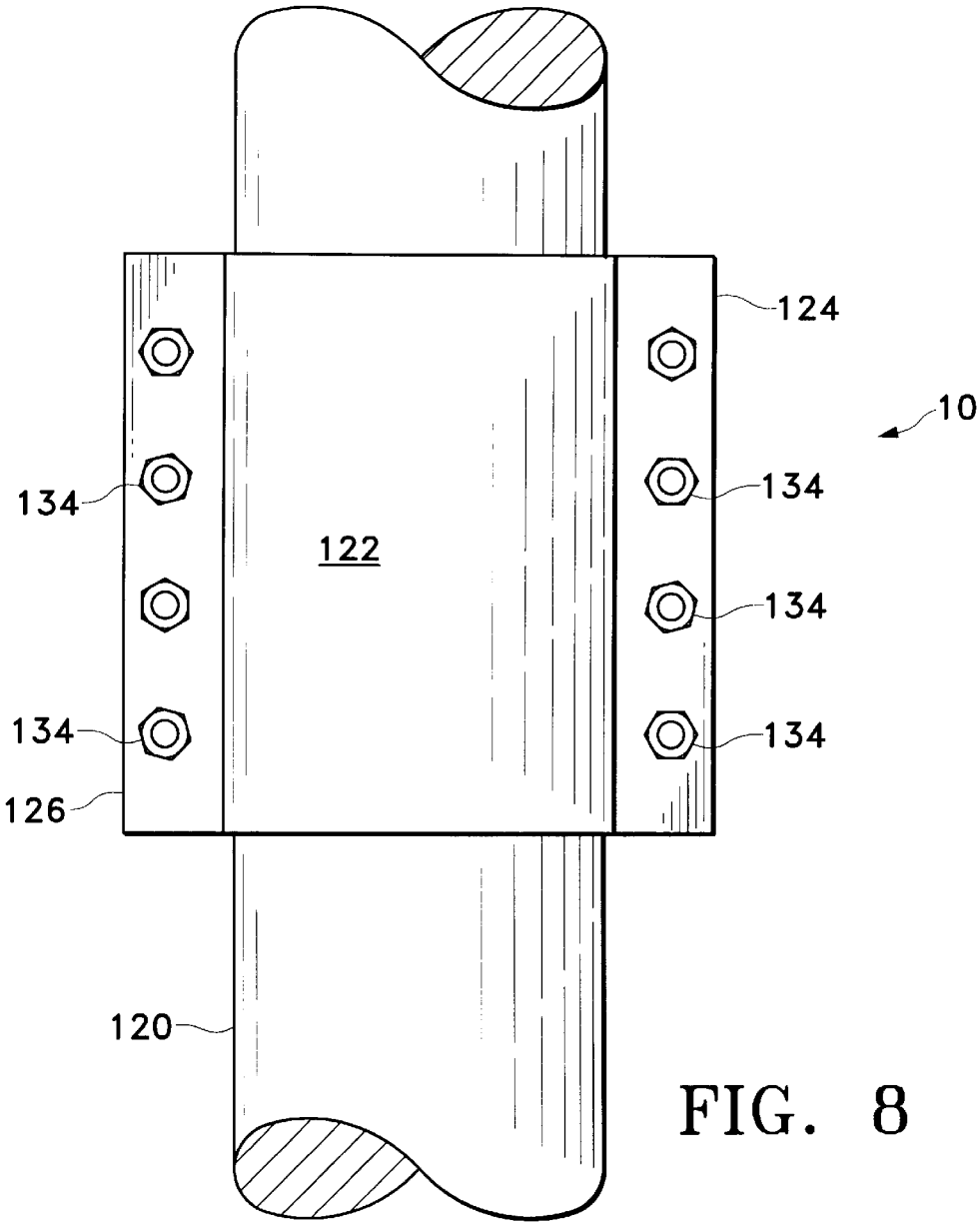
FIG. 8 is a side elevation of an alternative embodiment of the frictional coupler and stiffener of FIG. 1, which is for use with a cylindrical pile.
Figure 9:
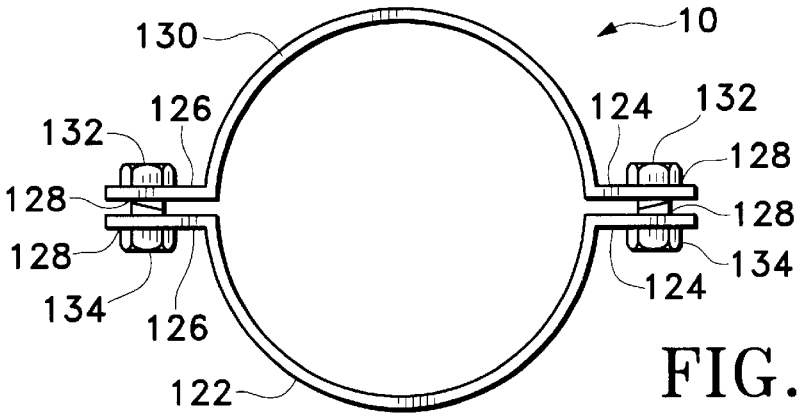
FIG. 9 is a top plan view of the frictional coupler and stiffener of FIG. 8.

Referring now to FIGS. 8, 9, there is shown an alternative embodiment of the frictional coupler for structural beams and piles 10 for use with a cylindrical pile 120 which may be either hollow or solid, having a deteriorated section such as that shown in FIGS.7, 10. In this embodiment, the frictional coupler 10 includes a first semi-circular band 122 having an outwardly projecting right-hand side flat flange 124 on a right-hand end of the semi-circular band 122 and a corresponding outwardly projecting left-hand side flange 126, with both flanges 124, 126 lying perpendicular to the semi-circular band 122 at the point from which they respectively project and each flange 124, 126 including a row of aligned apertures 128. A second semi-circular band 130 is identical to the first semi-circular band 122. The first and second semi-circular bands 122, 130 are placed about the cylindrical pile 120 as shown in FIG. 8 and the aligned apertures 128 are fastened together with the bolts 132 and nuts 134. The nuts are tightened progressively from the top of the friction coupler 10 to the bottom to a uniform torque. The frictional coupler 10 of FIGS. 8, 9 is suitable for use with any cylindrical pile 120, whether made of steel, concrete, wood or the like.

Figure 11:
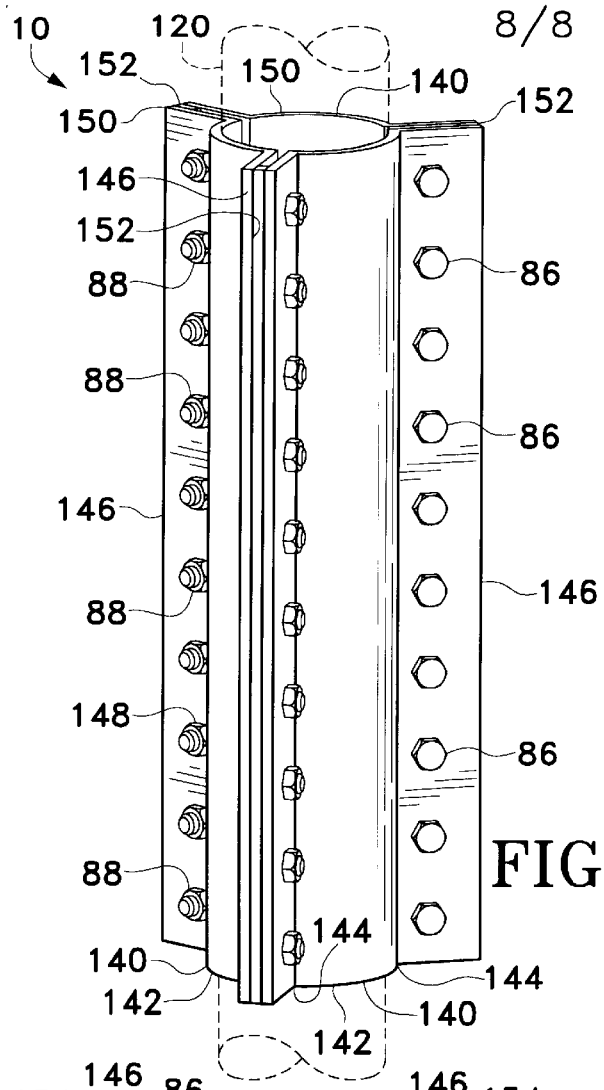
FIG. 11 is perspective view of an alternative embodiment of the frictional coupler and stiffener of FIG. 1 adapted for use in repairing a damaged cylindrical pile.
Figure 13:
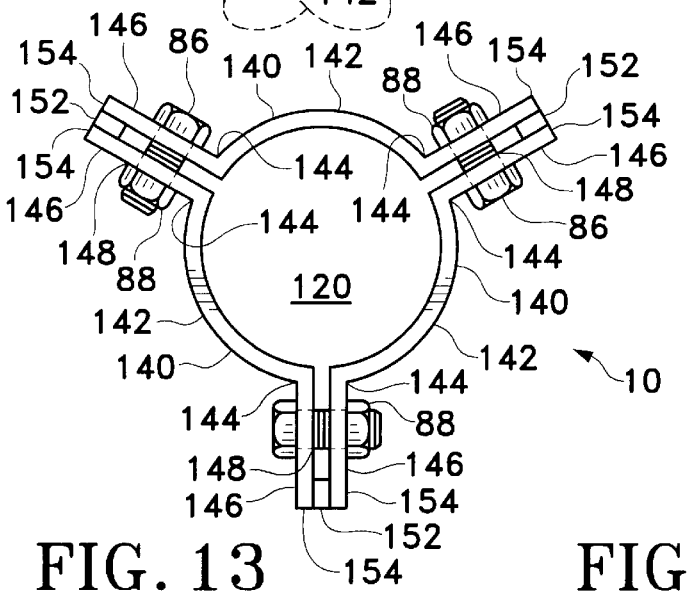
FIG. 13 is a top plan view of the frictional coupler and stiffener of FIG. 11.
Figure 12:
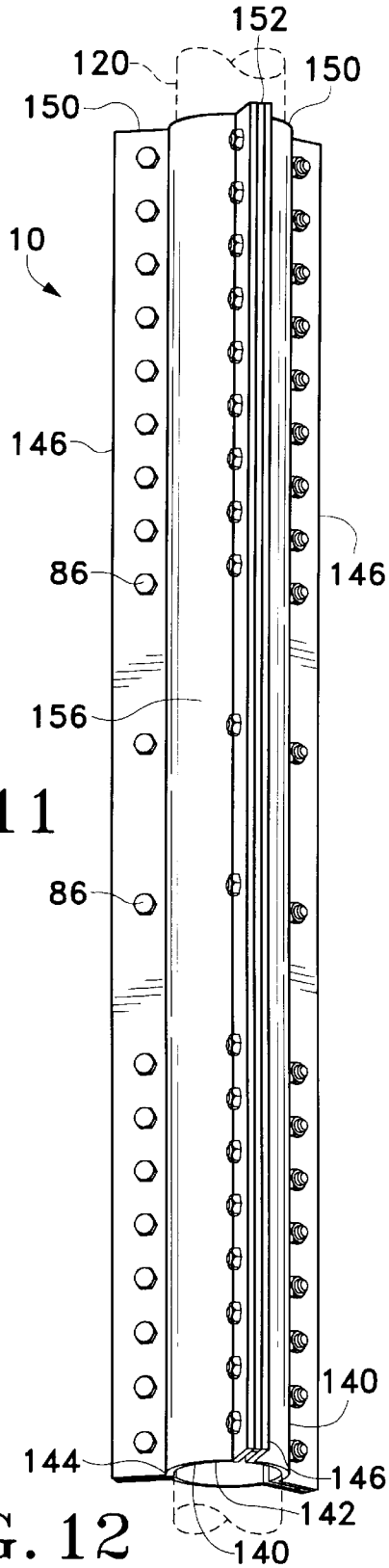
FIG. 12 is a side elevation of the frictional coupler and stiffener of FIG. 11.

Referring now to FIGS. 11–13, there is shown the frictional coupler and stiffener 10, shown about a cylindrical pile 120 having a deteriorated section such as that shown in FIGS. 7, 10, having three substantially symmetrical sheathing members 140, each including an arcuate portion 142 having a radius equal to the radius of the pile 120 and the three sheathing members each covering an arc of approximately 120° so as to form nearly a complete circle in a vertical cross section when mated. The vertical cross section should be somewhat less than a complete circle so that the arcuate portions 142 clamp the cylindrical pile 120 tightly when the flanges 142, discussed below, are fastened together. Each sheathing member 140 has the same length, which is defined as the vertical dimension as shown in FIGS. 11, 12, which is sufficient to bridge a deteriorated section of the pile 120 and be fastened to a sound portion of the pile 120 above and below the deteriorated section, as described above. Along each vertical edge 144 of the arcuate portion 142 a flange 146 is formed to project outwardly from the cylindrical pile 120 perpendicular to the outer surface of the cylindrical pile 120, which result in adjacent flanges 146, 146 being substantially parallel to each other. Each flange 146 includes a plurality of spaced apart holes 148, which are arranged with equal spacing in each flange 146 so that the holes 148 of adjacent flanges 146 are aligned when the sheathing members 140 are placed about a cylindrical pile 120 with the top edges 150 of each sheathing member 140 horizontally aligned. A flange spacing member 152, which runs the length of the sheathing members 140, is placed between adjacent flanges 146 adjacent to their outer edge 154 of each flange 146. The flange spacing member 152 is preferably welded to a flange 146 along its entire length to reduce the number of parts required and to reduce the underwater labor required for installation, but may be held in place by frictional engagement, spot welding, adhesives or the like, along one flange 146 in the position illustrated. Each flange spacing member 152 has a width that is one-third of the circumference of the cylindrical pile 120 minus the effective circumference of the three arcuate portions 142. That is, the flange spacing members 152 should have a width of that maintains adjacent flanges 146 parallel to one another prior to final tightening of the bolts 86 and nuts 88, which are fastened through the holes 148, thereby pinching the adjacent flanges 146, 146 together and squeezing the arcuate portions 142 firmly against the cylindrical pile 120. Because the frictional coupler and stiffener 10 of FIGS. 11–13 does not rely on any penetration of the cylindrical pile 120 itself, it can be used to repair a cylindrical pile 120 made from any material, such as wood, concrete, hollow steel, and so forth. In use, it is intended to use A325 structural bolts spaced 15.5 mm (6 inches) apart and tightened to 162 kg-m (1400 ft. lbs.) of torque. As shown in FIG. 12, it is not necessary to provide holes 148 uniformly throughout the entire length of the frictional coupler and stiffened 10, as only a few bolts 86 and nuts 88 are required along the central portion 156 of the length of the sheathing member 140, which is sufficient to prevent the compressive forces on the frictional coupler and stiffener 10 from translating into outward tension forces that would buckle the frictional coupler and stiffener 10. It is sufficient for the frictional coupler and stiffener 10 to grip the cylindrical pile 120 above and below the damaged or deteriorated section being repaired, resulting the frictional coupler and stiffener 10 carrying the compressive load formerly carried by the cylindrical pile 10.

In installation, the bolts 86 and nuts 88 are tightened in a crisscross sequence beginning with the bolts in the middle of the frictional coupler 10 and working outward toward the bolts 86 at the ends of the frictional coupler 10. In the case of a pile 12 that has a missing section, the same bolt tightening sequence is used. Each bolt is ultimately tightened to a torque of 185 kg-m (1,600 ft-lbs.). Force is applied to the frictional coupler 10 at a rate of 22,800 kg (50,000 lbs.) starting at 68,200 kg (150,000 lbs.) and continuing through to 182,000 kg (400,000 lbs.) and finally to a final load of 209,200 kg (460,000 lbs.). In an actual test of the H-pile repair embodiment of the frictional coupler and stiffener 10, each load was sustained for five minutes and the connections checked for movement after each interval of loading. The results of the test showed that the connection was able to withstand the 182,000 kg (400,000 lbs.) load with no residual movement. The allowable load for an HP14×73 pile with an effective length of 10–17 m (30–50 ft)varies from 270 kips to 108 kips, thereby providing a minimum factor of safety of 1.7.

Bend tests were also performed on the HP14/73 coupler connection by supporting the ends of the connection and applying a load at the center. The first test applied the load about the major axis and the second test applied the load about the minor axis. The loads used in the tests were the maximum allowable loads that an JP14/73 pile is designed to carry in bending for the actual span length of the connect. The span length for bending about the major axis was measured to be 3.2 m (10.5 feet), a span designed to carry a maximum allowable load of 36,700 kg (80,700 lbs.). The span length for bending about the minor axis was 2.8 m (9 feet 2 in.), resulting in a maximum allowable load of 16,000 kg (35,200 lbs.). Each of these loads was applied to the frictional coupler 10 connection and held for five minutes. The results of the test showed that the connection was able to withstand the maximum allowable load in bending about both the major and minor axis of the frictional coupler 10 without any residual movement and is thus deemed acceptable.

In each case, the various sections of the frictional coupler and stiffener 10 are lowered to the pile to be repaired with a crane, cable and wench or the like and then are placed against the pile by workers who initially assemble and secure the frictional coupler and stiffener 10 and then tighten it to final design specifications.

All parts of the frictional coupler 10 are pre-coated with epoxy, plastics, or are galvanized, thermal sprayed, or the like to eliminate corrosion in any environmental situation. If the pile 12 is damaged in the future, the new frictional coupler 10 is easily replaced and a longer frictional coupler 10 can be easily installed if needed. All parts are designed to provide the design strength of any particular pile 12. The frictional coupler 10 is intended for use with any type of pile 12, that is, a pile 12 of any cross sectional shape, such as circular, square, H-pile, or the like, and a pile made of any type of material, for example, steel, wood, concrete and so forth. The coupler 10 works by clamping bridging elements that bridge the deteriorated or damaged section of the pile and then clamping the bridging elements to the sound portions of the pile above and below the deteriorated section.

While the present invention has been described in accordance with the preferred embodiments thereof, the description is for illustration only and should not be construed as limiting the scope of the invention. Various changes and modifications may be made by those skilled in the art without departing from the spirit and scope of the invention as defined by the following claims.

I claim:

1. An apparatus for strengthening a section of pile comprising:

a. a first channel patch member inserted in to a channel of the pile and running from a first sound portion of the pile to a second sound portion of the pile, thereby bridging a deteriorated portion of the pile;

b. a second channel patch member inserted into a second channel of said pile and running from the first sound portion of the pile to the second sound portion of the pile, thereby bridging the deteriorated portion of the pile co-extensive with said first channel patch member;

c. four elongated locking bars;

d. a row of apertures in a left-hand side flange portion and in a right-hand side flange portion of each of said first and second channel patch members and in said four elongated locking bars; and e. means for fastening one of said elongated locking bars to one of each said side flange portions with an arm of said pile sandwiched between said one locking bar and said one side flange portion of said channel patch member.

2. An apparatus for strengthening a section of the pile in accordance with claim 1 wherein said first and second flange portion of each of said first and second channel patch members extends beyond the outer edges of flanges of said pile.

3. An apparatus for strengthening a section of the pile in accordance with claim 2 wherein said first and second channel patch members are U-shaped.

4. An apparatus for strengthening a section of the pile in accordance with claim 1 wherein flanges of said elongated locking bars have a width that is the same as the width of flanges of said pile.

5. An apparatus for strengthening a section of the pile in accordance with claim 1 wherein said fastening means further comprising a plurality of nuts and bolts inserted through said rows of aligned apertures tightened to clamp the flanges of said pile between said flanges of said elongated locking bars and said flanges of said first and second channel patch members.

6. An apparatus for strengthening a section of the pile in accordance with claim 5 further comprising a plurality of reinforcing straps connected between a pair of said elongated locking bars that lie along one of said flanges of said pile.

7. An apparatus for strengthening a section of a pile comprising:

a. a first U-shaped channel patch member inserted into a channel of an H-pile, said first U-shaped channel patch member further comprising right-hand side and left-hand side flanges extending from a corresponding right-hand side wall and left-hand side wall, said right-hand side wall and left-hand side wall being connected to each other by a back wall;

b. a second U-shaped channel patch member inserted into a second channel of said H-pile, said second U-shaped channel patch member further comprising right-hand side and left-hand side flanges extending from a corresponding right-hand side wall and left-hand side wall, said right-hand side wall and left-hand side wall being connected to each other by a back wall, and wherein said left-hand side flanges and said right-hand side flanges of said first and second channel patch members project outwardly beyond arms of said H-pile, thereby forming a marginal edge; and c. means for clamping said first and second channel patch members to said H-pile, wherein said means for clamping further comprises an elongated locking bar having a row of aligned apertures and an elongated flange connected to said elongated locking bar, said elongated flange disposed to contact said marginal edge of each said left-hand side and right-hand side flange of said first and second channel patch members, said marginal edge of each said left-hand side and right-hand side flanges further comprising a row of apertures along said marginal edges and means for fastening one of said elongated locking bars to one of said left-hand side and right-hand side flange of said first and second channel patch members with an outer flange portion of said H-pile clamped between said one elongated locking bar and said one of said left-hand side flange and right-hand side flange of said first and second channel patch members.

8. An apparatus for strengthening a section of the pile in accordance with claim 7 wherein said clamping means further comprises one of said bars having an elongated flange connected to said at least one elongated locking bar and perpendicular to said at least one of said elongated locking bars and said one elongated locking bar is connected to each of said left-hand side wall and right-hand side flanges of said first and second channel patch members.

9. An apparatus for strengthening a section of the pile in accordance with claim 8 wherein said elongated locking bar flange lies outside four of the arms of said H-pile and is the same thickness as each of said four arms of said H-pile.

10. An apparatus for strengthening a section of the pile in accordance with claim 8 wherein said fastening means further comprising a plurality of nuts and bolts inserted through rows of aligned apertures in each said elongated locking bar and each said channel member flange.

* * * * *